United States Patent [19]

Stover

[11] 4,129,334

[45] Dec. 12, 1978

[54] METHOD FOR LOCATING THE REMAINING RECOVERABLE MINERAL RESERVES DURING SOLUTION MINING

[75] Inventor: Dennis E. Stover, Plano, Tex.

[73] Assignees: Atlantic Richfield Company, Los Angeles, Calif.; NM Uranium, Inc., Houston, Tex.; The United States Steel Corporation, Pittsburgh, Pa.

[21] Appl. No.: 864,352

[22] Filed: Dec. 27, 1977

[51] Int. Cl.[2] ..... E21B 43/28

[52] U.S. Cl. ..... 299/4

[58] Field of Search ..... 299/4, 5; 166/250, 252

[56] References Cited

U.S. PATENT DOCUMENTS

| | | | |
|---|---|---|---|
| 3,708,206 | 1/1973 | Hard et al. | 299/5 |
| 3,713,698 | 1/1973 | Rhoades | 299/4 |
| 3,860,289 | 1/1975 | Learmont | 299/4 |
| 4,032,194 | 6/1977 | Howell et al. | 299/4 |
| 4,083,603 | 4/1978 | Stover | 299/4 |

OTHER PUBLICATIONS

Sievert et al.,"In Situ Leaching of Uranium", SME Preprint Number 70-AS-334, Oct. 1970.

*Primary Examiner*—Stephen J. Novosad
*Assistant Examiner*—George A. Suchfield
*Attorney, Agent, or Firm*—Ronnie D. Wilson

[57] ABSTRACT

The present invention relates to a method for the solution mining of a mineral from a subterranean formation. More specifically, the invention relates to a method which enhances significantly the recovery of a mineral from a subterranean formation via solution mining utilizing an oxidant and leach solution with an injection and production well. The method comprises ceasing oxidant injection via the injection well and measuring the change in mineral concentration in the pregnant solution recovered via the production well.

8 Claims, No Drawings

METHOD FOR LOCATING THE REMAINING RECOVERABLE MINERAL RESERVES DURING SOLUTION MINING

Generally, known methods for solution mining of a mineral in situ utilize an acid or alkaline leach solution for the dissolution of the mineral. An oxidant is injected into the formation along with the leach solution. The mineral is leached from the formation and recovered from a production well via a pregnant leach solution. Various procedures for recovering the mineral from the pregnant leach solution are well known, such as ion exchange.

The method of the present invention is particularly suitable for the leaching of uranium; however, my invention is not so limited. The following description of the present invention will be applied to uranium leaching; however, it is apparent that it is applicable to leaching other mineral values such as copper, nickel, molybdenum, rhenium and selenium where similar problems are encountered.

Although acid leaching solutions can be used in some formations, only alkaline leaching solutions can practically be used where the particular formation contains significant quantities of acid-consuming gangue.

It is well known that to recover uranium from an underground ore body, it is necessary to convert the relatively insoluble tetravalent state of uranium in the ore to the solubilizable hexavalent state. When using an alkaline leach solution, the dissolution of the uranium in solution occurs in two steps. The first step involves the oxidation of uranium by adsorbing oxygen and the second is the dissolution of the oxidized uranium in the solution.

During the early stages (when the ore body is in a reduced state) of a leach operation utilizing alkaline solutions of ammonium carbonate, sodium carbonate, potassium carbonate and their respective bicarbonates in conjunction with the typical oxidants of air, oxygen, and hydrogen peroxide, a portion of the uranium that is oxidized and dissolved near the injection well is reduced and precipitated in the more reduced regions of the formation between the injection well and the production well. Through this action the oxidized region of the formation is depleted of uranium and the reduced region of the formation becomes enriched as the leach operation continues. Therefore, this process of oxidation and dissolution followed by partial reduction and precipitation continues as the formation becomes progressively oxidized, whereby the region in the immediate vicinity of the production well becomes progressively enriched. As a result, the uranium is depleted from a zone in the formation far more quickly than the oxidant consuming gangue species present therein.

Therefore, as the uranium oxidation front recedes from the injection well, the oxidant available for uranium oxidation decreases. This causes a slower dissolution of uranium and a lower maximum concentration of uranium in solution as the depleted zone moves through the formation. The continued injection of oxidant and leach solution through an injection well away from which the uranium oxidation front has moved is wasteful, since most of the injected oxidant reacts with gangue material and leach solution contacts little oxidized uranium. Fluid produced from a production well in exclusive communication with such an injection well contains little or no uranium. In a multi-well configuration, the fluid dilutes the uranium concentration fron other wells and thereby decreases the efficiency of th operation. To conduct a solution mining operation effi ciently and provide for maximum uranium recovery, i is necessary to focus the flow of oxidant and leachant o the remaining uranium reserves and to minimize th flow through depleted or barren areas of the formation To achieve this, the location of the remaining uraniun reserves must be known. Therefore, there is needed method whereby the remaining reserves in a formatio containing a mineral such as uranium can be located an recovered with a leach solution without being accom panied by excessive losses of oxidant and leach solution Therefore, it is an object of the present invention t provide a method for the solution mining of a minera from a subterranean formation, applicable generally t minerals requiring oxidation to be leached and to bot acid and alkaline leach solutions.

A further object of the present invention is to provid a method for the solution mining of uranium.

It is an additional objective of the present inventio to provide a method for locating remaining reserve recoverable by solution mining from subterranean de posits.

Other objects, aspects, and the several advantages c the present invention will become apparent upon a fu ther reading of this disclosure and the appended claim It has now been found that the objects of the presen invention can be attained in the solution mining of mineral from a subterranean formation containing sam where an injection and production well are drilled an completed within said formation, a leach solution an an oxidant are injected through the injection well int the formation to dissolve the mineral and recover it vi a production well, by temporarily ceasing the injectio of oxidant and measuring the change in mineral concer tration in the solution recovered via the productio well.

In the operation of the present invention to locat remaining recoverable uranium, the injection of oxida into a given injection well is stopped while continuin leach solution injection for a period of time required t measure the change in uranium concentration in th pregnant leach solution recovered via the productio well. By measuring the uranium concentration in th pregnant solution without oxidant injection, one ca determine the relative uranium production contribute by a given injection well. Thus, the remaining recove able uranium is located and steps taken to most eff ciently utilize oxidant and leach solution to recov same.

Of course, the period of time which oxidant injectic should be stopped will vary from formation to form tion. Suitable dye tests can be made to determine mo specifically the actual time needed to yield a good o servation of the location of the reserves remaining.

The following illustrations will show the effecti operation of the present invention.

1. When the ceasing of oxidant injection into an inje tion well produces no change in the uranium concentr tion of the pregnant solution recovered from an adj cent production well, the recoverable uranium in t area is completely oxidized. Thus, oxidant injecti should be permanently stopped because continued i jection merely oxidizes the gangue material prese therein. Leach solution should continue to be inject to recover the oxidized uranium.

. When the individual interruption of oxidant injec-
ı into four offset injection wells centered by a pro-
:tion well shows that three of the wells provide es-
tially all of the uranium production, the recoverable
nium has been depleted near the fourth well. The
rth injection well should be abandoned for efficient
:ration.

. By the testing of four offset injection wells cen-
ɜd by a production well via oxidant cessation, it is
nd that the four injection wells are contributing to
production of uranium in the order of 5, 15, 30 and
% corresponding to each of the wells. Since the con-
ıtration of uranium in the pregnant solution is pro-
·tional to the remaining recoverable reserves, this
ıws that the latter injection well has the largest
ount of remaining recoverable reserves. By utilizing
information obtained, an efficient strategy of final
pper stage of operation can be developed.

Therefore, through the utilization of the present in-
ıtion, the recovery of uranium via in situ leaching
ıcesses can be enhanced significantly by most effec-
ɜly using the oxidant and leach solution to recover
ıaining reserves present in the formation.

In addition, the present invention provides direct
asurements of the pattern performance under normal
ɜrating conditions, since the stream lines between
ɜction and production wells remain constant during
utilization.

Having thus described my invention, I claim:

1. A method for locating the remaining mineral re-
ves recoverable via solution mining from a subterra-
ın formation containing said mineral in which an injection and production well are drilled and completed within said formation, leach solution and an oxidant are injected through said injection well into said formation to dissolve said mineral, and said dissolved mineral is recovered via said production well, which comprises temporarily ceasing said injection of oxidant and measuring the change in mineral concentration in the solution recovered via said production well.

2. The method of claim 1 wherein said mineral is selected from the group consisting of copper, nickel, molybdenum, rhenium, selenium and uranium.

3. The method of claim 1 wherein said leach solution is acidic in nature.

4. The method of claim 3 wherein said acid leach solution is selected from the group consisting of hydrochloric and sulfuric acid.

5. The method of claim 1 wherein said leach solution is alkaline in nature.

6. The method of claim 5 wherein said alkaline leach solution is an aqueous solution of one or more salts selected from the group consisting of ammonium carbonate, sodium carbonate, potassium carbonate and their respective bicarbonates.

7. The method of claim 1 wherein said oxidant is selcted from the group consisting of air, oxygen and hydrogen peroxide.

8. The method of claim 1 wherein said injection and said production well are arranged in a five spot pattern having one production well centered between four offset injection wells.

* * * * *